US011383518B2

(12) United States Patent
Byun et al.

(10) Patent No.: US 11,383,518 B2
(45) Date of Patent: Jul. 12, 2022

(54) INDUCED ELECTROHYDRODYNAMIC JET PRINTING APPARATUS INCLUDING AUXILIARY ELECTRODE

(71) Applicant: ENJET CO. LTD., Suwon-si (KR)

(72) Inventors: Do Young Byun, Seoul (KR); Yong Hee Jang, Suwon-si (KR); Vu Dat Nguyen, Suwon-si (KR)

(73) Assignee: Enjet Co. Ltd., Suwon-si (KR)

( * ) Notice: Subject to any disclaimer, the term of this patent is extended or adjusted under 35 U.S.C. 154(b) by 0 days.

(21) Appl. No.: 17/185,486

(22) Filed: Feb. 25, 2021

(65) Prior Publication Data

US 2021/0260876 A1 Aug. 26, 2021

(30) Foreign Application Priority Data

Feb. 25, 2020 (KR) ..... 10-2020-0022783

(51) Int. Cl.
*B41J 2/14* (2006.01)

(52) U.S. Cl.
CPC .. *B41J 2/14314* (2013.01); *B41J 2002/14491* (2013.01)

(58) Field of Classification Search
CPC ..... B41J 2/14314; B41J 2002/14491; B41J 2/1433; B41J 2/162; B41J 2002/14475
See application file for complete search history.

(56) References Cited

U.S. PATENT DOCUMENTS 4,333,086 A 6/1982 Ebi
4,364,054 A 12/1982 Kelly

FOREIGN PATENT DOCUMENTS

JP 8-142330 A 6/1996
JP 9-239988 A 9/1997
JP 2004-165587 A 6/2004

*Primary Examiner* — Kristal Feggins

(74) *Attorney, Agent, or Firm* — Saliwanchik, Lloyd & Eisenschenk

(57) ABSTRACT

The present disclosure relates to an induced electrohydrodynamic jet printing apparatus including an induced auxiliary electrode, and the induced electrohydrodynamic jet printing apparatus including an induced auxiliary electrode according to the present disclosure includes a nozzle for discharging supplied solution towards an opposite substrate through a nozzle hole formed at one end; a main electrode coated with an insulator and interpolated inside the nozzle, thus not contacting the solution inside the nozzle but separated from the solution; the induced auxiliary electrode made of a conductive material and formed at an outer surface of the nozzle; and a voltage supply for applying voltage to the main electrode.

9 Claims, 6 Drawing Sheets

| | Images | Working Voltage | Line Width |
|---|---|---|---|
| PRESENT DISCLOSURE ( iEHD + INDUCED AUXILIARY ELECTRODE ) |  | V=0.12 kV | 0.84 μm |
| PRIOR ART EHD |  | V=0.24 kV | 1.34 μm |
| iEHD |  | V=0.26 kV | 0.93 μm |

INDUCED ELECTROHYDRODYNAMIC JET PRINTING APPARATUS INCLUDING AUXILIARY ELECTRODE

CROSS-REFERENCE TO RELATED APPLICATION

This application claims the benefit of Korean Application No. 10-2020-0022783, filed Feb. 25, 2020, which is hereby incorporated by reference in its entirety.

FIELD

The present disclosure relates to an electrohydrodynamic jet printing apparatus that is based on induced electrostatic force caused by electric charges induced under an electric field, and more particularly, to an induced electrohydrodynamic jet printing apparatus including an induced auxiliary electrode, for discharging a solution charged with the electrostatic force being induced to a liquid level at a tip of a nozzle by the electric field, but with improved jetting performance by having the induced auxiliary electrode separately from a main electrode to which high voltage may be applied.

BACKGROUND

In general, an inkjet printer or a dispenser refers to a device made to be used by ejecting a certain amount of contents such as gas, liquid or other contents filled inside an airtight container by a pressurization means or a pressure wave transmission means such as a piezoelectric element.

In recent years, even in the field of miniaturized precision industries such as electronic components and camera modules, dispensers have been used for discharging a chemical solution for coating a specific area or for bonding processes. Further, also in the OLED display industry field, inkjet printers are used for organic film coating in encapsulation processes and for patterning color materials such as red, green and the like of pixels. Further, applying materials such as ink is being considered as a method for connecting open defects of electrodes such as the source, drain, and gate of thin-film-transistors of OLED backplane. Dispensers or printers used in such fields require more precise control of discharge amount and discharge of fine droplets.

As a method of jetting droplets, piezoelectric method and electrohydrodynamic (EHD) method have been widely used. Among them, the electrohydrodynamic method is a method of discharging ink using electrostatic force caused by a potential difference between an electrode in a nozzle and a substrate. It has been widely used in the technical field for precise discharging because it can implement a fine line width.

Existing jetting technologies that use electrohydrodynamics are methods that discharge droplets by placing an electrode inside the nozzle so that a voltage can be applied to supply electric charges to the solution inside the nozzle, thereby charging it and generating an electrostatic force. When this wonder electrode contacts the liquid in the nozzle, free electrons are transferred from the electrode to the liquid, or ions are formed by dissociation on the surface of the electrode, and current flows through the liquid by the transfer of ions. Here, the liquid is discharged by the electrostatic force acting according to the strength of the electric field formed due to the voltage being applied to the electrode. The functional inks that are discharged are usually those made by dispersing materials such as nano metal particles, polymers, biomaterials, binders and the like to various solvents. These materials are charged themselves, and contribute to the formation of ions by activating dissociation in the electrode.

However, such prior art jetting technologies that use electrohydrodynamics have a structure where the electrode directly contacts the solution inside the nozzle, and therefore, in the dissociation process, an oxidation-reduction reaction occurs on the surface of the electrode, which makes electrode ions generated from the electrode mix with the solution for the jetting in the nozzle, thus leading to a problem of the solution being denatured by the heat generated in the oxidation-reduction reaction. In this case, a problem of clogging the nozzle due to the denaturation of the solution may occur, and bubbles may be generated, causing a serious problem in jetting. Further, depending on the electrical conductivity of the solution, the current may flow back and cause a malfunction of the valve that may exist between the nozzle and the solution chamber.

PRIOR ART LITERATURE

Patent Literature

U.S. Pat. No. 4,333,086
U.S. Pat. No. 4,364,054
Japanese Laid-open Patent: No. 2004-165587

SUMMARY

Therefore, a purpose of the present disclosure is to resolve such problems of prior art, that is to provide an induced electrohydrodynamic jet printing apparatus that includes an induced auxiliary electrode, in which a solution in a nozzle and a main electrode to which voltage may be applied are separated from each other by an insulator and the solution is discharged from the nozzle by electrostatic force by electric charges induced under an electric field generated when a voltage is applied to the main electrode so as to resolve problems of prior art such as heat generation, degeneration of solution, clogged nozzle, generation of bubbles led from an oxidation-reduction reaction caused by the solution's direct contact to the electrode, but also with further improved jetting performance by formation of the induced auxiliary electrode at an outer surface of the nozzle.

The problems to be resolved by the present disclosure are not limited to the problems mentioned above, and other problems not mentioned will be clearly understood by those skilled in the art from the following description.

The aforementioned purposes of the present disclosure may be achieved by an induced electrohydrodynamic jet printing apparatus including an induced auxiliary electrode, including: a nozzle for discharging supplied solution towards an opposite substrate through a nozzle hole formed at one end; a main electrode coated with an insulator and interpolated inside the nozzle, thus not contacting the solution inside the nozzle but separated from the solution; the induced auxiliary electrode made of a conductive material and formed at an outer surface of the nozzle; and a voltage supply for applying voltage to the main electrode.

Here, the induced auxiliary electrode may be not electrically connected, or a voltage different from that of the main electrode may be applied, or grounded.

Here, the induced auxiliary electrode may be formed in a shape extending towards an inner surface of the nozzle through a tip of the nozzle.

Here, the voltage supply may apply a DC voltage to the main electrode.

Here, the voltage supply may apply an AC voltage to the main electrode.

Here, the voltage supply may supply the AC voltage of a waveform that includes at least one of sine wave, triangle wave and square wave.

Here, the main electrode may be formed in a needle shape.

Here, the main electrode may be formed in a tube shape.

Here, the induced electrohydrodynamic jet printing apparatus including an induced auxiliary electrode may further include a substrate bottom electrode disposed below the substrate, and a potential difference may be formed between the main electrode and the substrate bottom electrode.

Here, the substrate bottom electrode may be grounded.

According to the induced electrohydrodynamic jet printing apparatus that includes an induced auxiliary electrode of the present disclosure mentioned above, it is possible to separate the solution in the nozzle and the main electrode from each other using the insulator, and thus there is an advantage of resolving the problem of heat generation, degeneration of solution, clogged nozzle, generation of bubbles led from an oxidation-reduction reaction caused by the voltage being applied to the electrode as the solution contacts the electrode.

Further, there is also an advantage that jetting by induced electrostatic force acting at the liquid level of the tip of the nozzle by the electric field is possible even when there is no transfer of electric charges by a direct contact of the electrode and solution, thereby reducing the jetting sensitivity according to electrical conductivity of the solution.

Further, there is an advantage of further improving the jetting characteristics by forming the induced auxiliary electrode separately from the main electrode and improving the characteristics of the induced electric field.

Further, there is an advantage that in the case of coating and forming the induced auxiliary electrode at an outer surface instead of an inner surface of the nozzle, it is easy to produce the induced auxiliary electrode at the same time as improving the jetting performance such as the voltage efficiency, realization of fine line width and the like.

DETAILED DESCRIPTION

Figure 1:
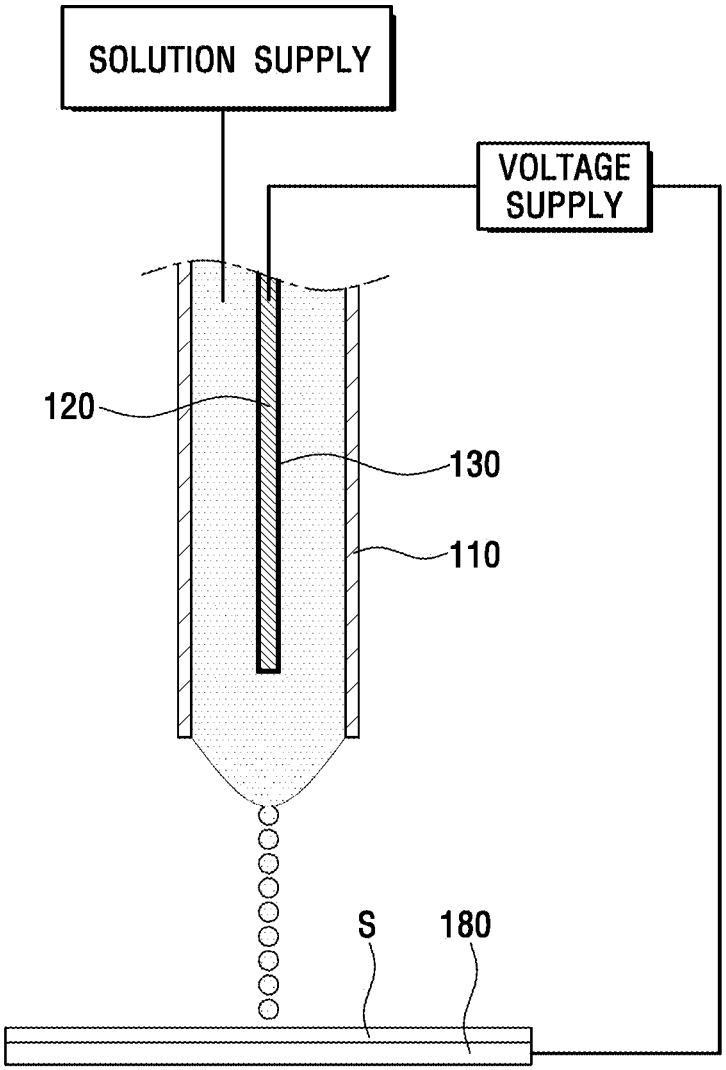
FIG. 1 is a cross-sectional view describing a basic configuration of an induced electrohydrodynamic jet printing apparatus according to the present disclosure.

Specific matters of the embodiments are included in the detailed description and the drawings.

Advantages and features of the present disclosure, and methods for achieving them will become apparent with reference to the embodiments described below in detail together with the accompanying drawings. However, the present disclosure is not limited to the embodiments disclosed below, but may be implemented in various different forms, and the present embodiments are only provided to fully complete the disclosure of the present disclosure, and to fully inform a person of ordinary skill in the art where the present disclosure pertains to of the scope of the present disclosure, and the present disclosure is only defined by the scope of the claims. Throughout the specification, like reference numerals indicate like components.

Herein below, the present disclosure will be described with reference to the drawings for describing an induced electrohydrodynamic jet printing apparatus including an induced auxiliary electrode by the embodiments of the present disclosure.

First, an induced hydrodynamic jet printing apparatus according to the present disclosure will be described with reference to FIGS. 1 to 3.

Figure 2:
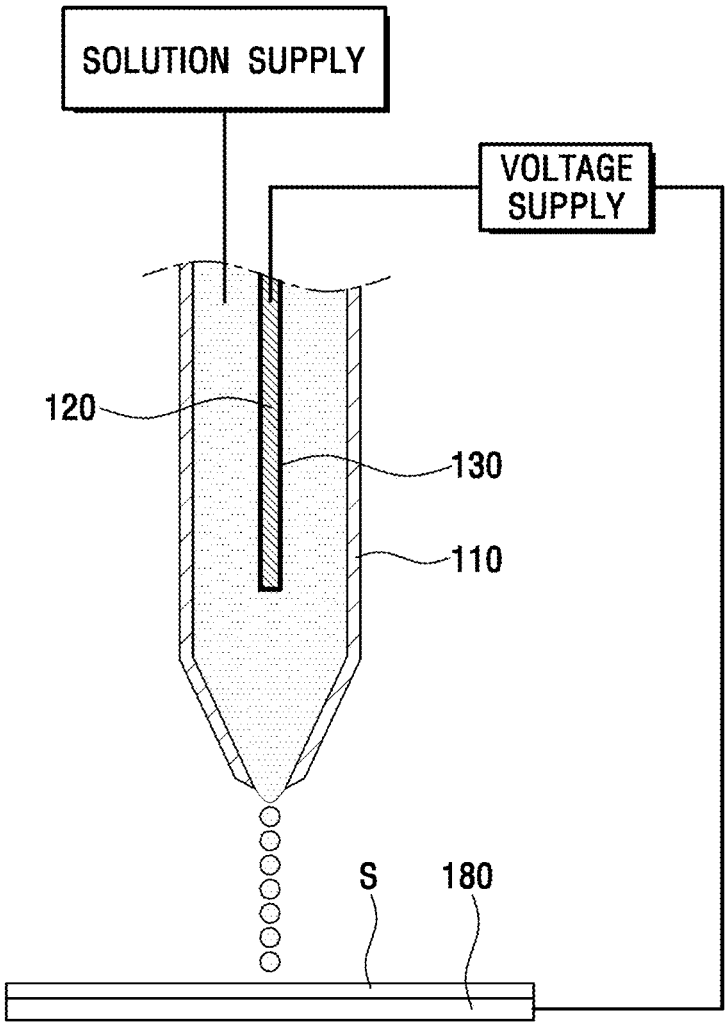
FIG. 2 is a modified example of FIG. 1.
Figure 3:
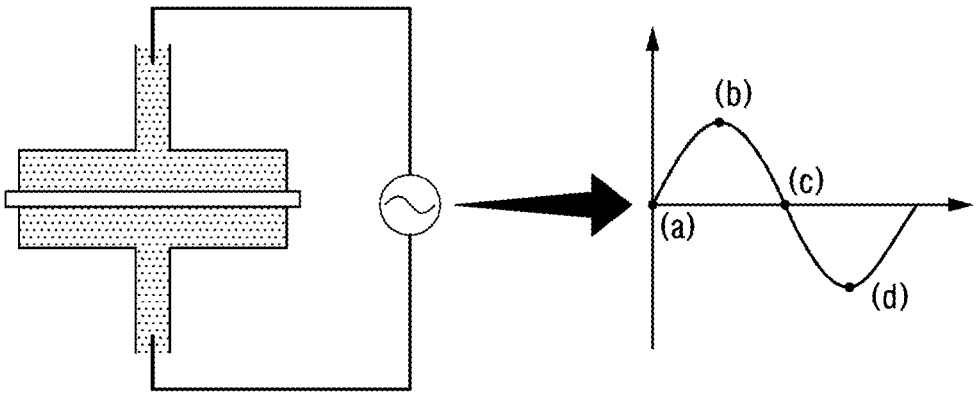
FIG. 3 is for describing the principle of the present disclosure, illustrating changes in a charged state capable of attaining the same effect as when electric charges are being transferred even when the main electrode and the solution do not contact each other in the present disclosure by a displacement current when an AC voltage is applied to a capacitor.
Figure 3:
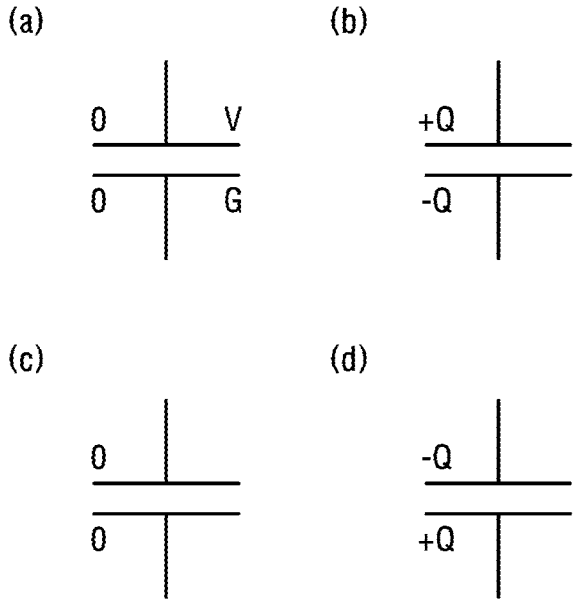

FIG. 1 is a cross-sectional view describing a basic configuration of an induced electrohydrodynamic jet printing apparatus according to the present disclosure, FIG. 2 is a modified example of FIG. 1, and FIG. 3 is for describing the principle of the present disclosure, illustrating changes in a charged state capable of attaining the same effect as when electric charges are being transferred even when the main electrode and the solution do not contact each other in the present disclosure by a displacement current when an AC voltage is applied to a capacitor.

An induced electrohydrodynamic jet printing apparatus according to the present disclosure may include a nozzle 110, a main electrode 120 and a voltage supply.

The nozzle 110 receives a supply of solution from a solution supply and discharges the solution through a nozzle hole formed at a nozzle tip of a lower end by an electrostatic force being induced by an AC or DC voltage as will be mentioned below. Here, the nozzle 110 is formed in a cylindrical shape having a constant inner diameter with a circular cross-section from top to bottom, but there is no limitation thereof. As illustrated in FIG. 2, the lower end of the nozzle 110 where the nozzle hole is formed may be tapered so that the inner diameter gradually decreases toward the bottom. The nozzle may of course be formed in a square cylindrical shape, or a polygonal cylindrical shape.

Here, it is preferable that the nozzle hole through which the solution may be discharged has a diameter of not greater than 50 μm, and in some cases, not greater than 1 μm.

The solution supply supplies the solution to the inside of the nozzle 110 at a predetermined pressure, and may be configured as a pump, valve and the like.

A main electrode 120 is inserted into an inner center of the nozzle 110, to receive a DC or AC voltage from the voltage supply. As illustrated, the main electrode 120 may be formed in a needle shape. Otherwise, it may be formed in the shape of a long hollow tube.

Here, the outer side of the main electrode 120 is coated with an insulator, to form an insulating layer 130. Accordingly, the main electrode 120 and the solution inside the nozzle 110 do not directly contact each other but are separated by the insulating layer 130. Since the solution inside the nozzle 110 and the main electrode 120 can be separated by the insulating layer 130, an oxidation-reduction reaction can be inhibited from occurring between the solution and the main electrode 120 when a high voltage is applied to the main electrode 120, and the problems of heat generation, degeneration of solution, generation of bubbles, and clogging of the nozzle 110 due to the oxidation-reduction reaction can be resolved.

Here, as the insulator forming the insulating layer 130, epoxy polymer, fluorocarbon-based coating agents and the like may be used. In order to insulate the main electrode 120, an oxide film may be formed on a metal surface, and an epoxy or phenolic based polymer coating, ceramic coating, glass and the like may be used, but there is no limitation thereto.

The voltage supply applies a DC or AC voltage to the main electrode 120 that is located inside the nozzle 110. Here, the waveform of the voltage being applied by the voltage supply may be one of various waveforms such as sinusoidal, triangular, square waves and the like.

Underneath a substrate S to which the solution may be discharged, another substrate bottom electrode 180 may be formed, and the voltage supply may apply different voltages to the substrate bottom electrode 180 and the main electrode 120, thus forming a potential difference between the substrate bottom electrode 180 and the main electrode 120. Otherwise, the substrate bottom electrode 180 may be grounded.

$$\vec{f}_e \rho_e \vec{E} - \tfrac{1}{2}|\vec{E}|^2 \Leftrightarrow \varepsilon + \nabla(\tfrac{1}{2}(\varepsilon - \varepsilon_0)|E|^2) \quad (1)$$

The above Mathematical Equation 1 is a formula expressing the force acting on the solution existing under the electric field. (Here, $f_e$ is the electric force, $\rho_e$ is the charge density, E is the dielectric coefficient, ε0 is the dielectric coefficient in a vacuum state, and E is the electric field strength.)

The first term in the equation on the right is the Coulomb force, which is the force acting on the solution containing free charges. It is the greatest force acting by the electric charges transferred when the solution directly contacts the electrode. In the present embodiment, the Coulomb force may act by an induced current that is formed when an AC voltage is applied. The second term is the dielectric force formed when an electric field acts on a non-homogeneous dielectric liquid. This force is weaker than the Coulomb force when the electrode is in direct contact with the liquid, but when using an induced current as in the present embodiment, the dielectric force may also act large. The third term is the force by electrostrictive pressure, which is the force of pressure generated when an uneven electric field is distributed on the liquid level of the liquid.

As illustrated on the left side of FIG. 3, a capacitor is a circuit element in which a dielectric made of an insulating material is sandwiched between two conductive metal plates. Here, when a DC voltage is applied, the capacitor performs the role of a charger where current does not flow, but when an AC voltage is applied, a phenomenon occurs where the current flows as the flow of electric charges changes alternately, which is referred to as displacement current.

In the present embodiment, similarly to when an AC voltage is applied to the capacitor, the solution in the nozzle 110 and the main electrode 120 are separated by the insulating layer 130 coated on the outer surface of the main electrode 120, and when an AC voltage is applied to the main electrode 120, induced electric charges act on the solution in the nozzle 110 due to the repetition of + and − electric signals, thereby having an effect of flowing a current. In this way, it is possible to charge the solution with the induced electric force by the AC voltage applied from the voltage supply, and form an electric field, and thus discharge the solution with the Coulomb force.

In the present embodiment, in the case of applying a DC voltage to the main electrode 120, when the voltage is applied using the insulated electrode, but an electric field is formed between the liquid level at the tip of the nozzle and the substrate, if the liquid is a polar solvent, induced electric charges caused by polarization will be formed along the liquid level and the Coulomb force caused by the electric field will act on. Even when the solution contains charged polymers, nanoparticles, biomaterials and the like in the solution, they will be distributed on the liquid level according to the electric charges of the materials and the electric field, and thus leading to additional electric force to act on. Further, the dielectric force and the electrostrictive pressure force may contribute to discharging the liquid in the induced electrohydrodynamic jet printing of the present disclosure.

Such an induced electrohydrodynamic jet printing apparatus according to the present disclosure has the main electrode 120 coated with an insulator interpolated in the nozzle 110, so as to separate the main electrode 120 and the solution using the insulating layer 130, thereby inhibiting their contact, and allows the solution to be discharged from the nozzle 110 by the electrostatic force caused by the induced charge under the electric field being generated when the DC or AC voltage is applied to the main electrode 120. Therefore, the solution is discharged in the electrohydrodynamic method by the electric charges being induced even without direct contact between the solution and the main electrode 120.

Here, the induced electrohydrodynamic jet printing apparatus including an induced auxiliary electrode according to an embodiment of the present disclosure further includes the induced auxiliary electrode 150 in the configuration of FIGS. 1 and 2, so as to improve the characteristics of the induced electric field, thereby further improving the jetting characteristics.

Figure 4:
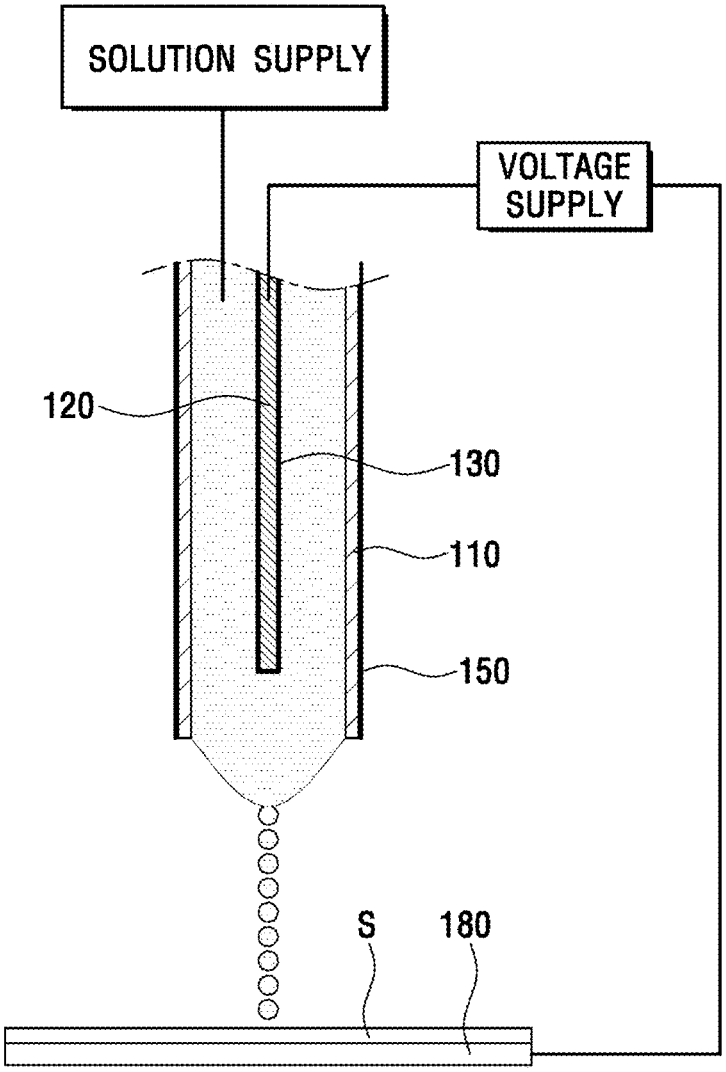
FIG. 4 is a view illustrating an induced electrohydrodynamic jet printing apparatus that includes an induced auxiliary electrode according to an embodiment of the present disclosure.
Figure 5:
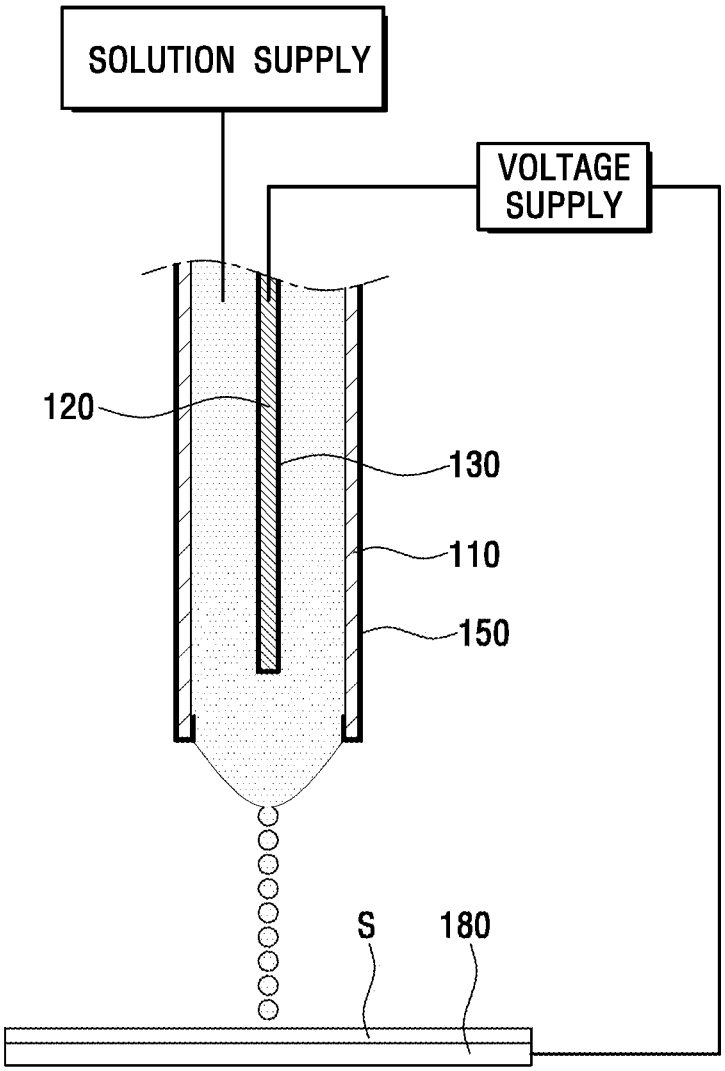
FIG. 5 is a modified example of FIG. 4.
Figure 6:
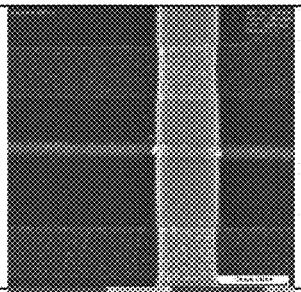
FIG. 6 is a view showing a jetting test result conducted on an induced electrohydrodynamic jet printing apparatus including an induced auxiliary electrode according to the present disclosure, a prior art electrohydrodynamic jet printing apparatus having a structure where an electrode is interpolated to contact a solution, and an induced electrohydrodynamic jet printing apparatus that does not include an induced auxiliary electrode as in FIG. 1.
Figure 6:
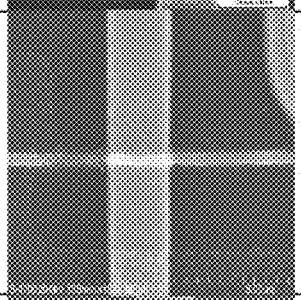
Figure 6:
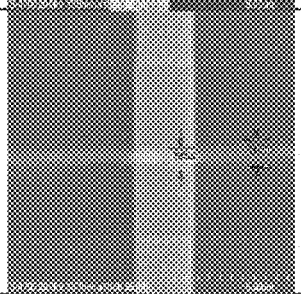

FIG. 4 is a view illustrating an induced electrohydrodynamic jet printing apparatus including an induced auxiliary electrode according to an embodiment of the present disclosure, FIG. 5 is a modified example of FIG. 4, and FIG. 6 is a view showing a jetting test result conducted on an induced electrohydrodynamic jet printing apparatus including an induced auxiliary electrode according to the present disclosure, a prior art electrohydrodynamic jet printing apparatus having a structure where an electrode is interpolated to contact a solution, and an induced electrohydrodynamic jet printing apparatus that does not include an induced auxiliary electrode as in FIG. 1.

As illustrated in FIG. 4, the induced auxiliary electrode 150 may be formed at an outer surface of the nozzle 110. More specifically, the induced auxiliary electrode 150 may be formed in a method for coating the outer surface of the nozzle 110 with a conductive material.

The electrode materials of the induced auxiliary electrode 150 may include metal materials including gold, silver, copper, aluminum and the like, conductive oxide materials such as ITO, ZTO and the like, conductive polymers such as PEDOT, and carbon-based conductive materials such as graphene.

Here, the induced auxiliary electrode 150 may be electrically not connected, or a voltage different from the main electrode 120 may be applied, or grounded.

In the case where the induced auxiliary electrode 150 is formed separately from the main electrode 120 interpolated in the nozzle 110, when a voltage is applied to the main electrode 120, thus generating an induced current inside the solution, it is possible to further reinforce the induced electric field, thereby further improving the jetting characteristics.

In the perspective of forming the induced electric field, the main electrode 120 may be seen as an emitting electrode that sends out electric signals, whereas the induced auxiliary electrode 150 may be seen as a receiving electrode that accepts the electric signals coming from the main electrode 120. Therefore, even without electrically connecting the induced auxiliary electrode 150, with only the existence of the induced auxiliary electrode 150, it is possible to reinforce the induced electric field, thus further improving the jetting characteristics.

The induced auxiliary electrode 150 may be formed in the method of coating an inner surface of the nozzle 110, but in the present embodiment, the induced auxiliary electrode 150 is formed at the outer surface of the nozzle 110.

FIG. 5 illustrates a modified example of FIG. 4. An induced auxiliary electrode 150 may be coated and formed at the outer surface of the nozzle 110, but that the induced auxiliary electrode 150 formed at the outer surface partially extends towards inside the nozzle through the nozzle tip. In such a case, it is possible to further concentrate the induced electric charges near the nozzle tip, thereby further improving the jetting performance.

FIG. 6 sequentially shows a jetting test result conducted on an induced electrohydrodynamic jet printing apparatus including an induced auxiliary electrode 150 formed at an outer surface of the nozzle 110 as in FIG. 4, a prior art electrohydrodynamic jet printing apparatus having a structure where an electrode is interpolated in the nozzle to contact a solution, and an induced electrohydrodynamic jet printing apparatus that does not include an induced auxiliary electrode 150 as in FIG. 1.

It is confirmed that in the case where the induced auxiliary electrode 150 is formed at the outer surface of the nozzle 110 as in the present disclosure, the solution can be discharged with a much smaller operation voltage (0.12 kV), and moreover, a fine line width (0.84 μm) can be implemented. Further, it is confirmed that the jetting function of the induced electrohydrodynamic jet printing apparatus of the present disclosure is further improved when using the induced auxiliary electrode 150 in terms of the operation voltage and line width compared to when not using the induced auxiliary electrode 150.

The spray solution used in the electrohydrodynamic jet printing that may be used in the present disclosure is a conductive nano ink composition, that includes a conductive nano structure, a polymer compound, a wetting and dispersing agent, and an organic solvent. Since the conductive nano structure has excellent electric, mechanic and thermal properties, it can be the base material of the conductive nano ink composition. It is preferable that the conductive nano ink composition has a nano particle form, or a one-dimensional nano structure such as nano wire, nano rod, nano pipe, nano belt and nano tube, or may be used in combinations of a nano particle form and the one-dimensional nano structure mentioned above. Further, it is preferable that the conductive nano structure has a nano structure or a carbon nano tube consisting of one or more selected from a group consisting of gold (Au), silver (Ag), aluminum (Al), nickel (Ni), zinc (Zn), copper (Cu), silicon (Si) and titanium (Ti), or combinations thereof. The polymer compound is for adjusting the viscosity of the conductive nano ink composition and optical characteristics, and there is no limitation to the type of the natural polymer compound and synthetic polymer compound. Here, preferable examples of the natural polymer compound includes at least one of chitosan, gelatin, collagen, elastin, hyaluronic acid, cellulose, silk fibroin, phospholipids and fibrinogen, preferable examples of the synthetic polymer compound includes at least one of PLGA (Poly(lactic-co-glycolic acid)), PLA(Poly(lactic acid)), PHBV(Poly(3-hydroxybutyrate-hydroxyvalerate), PDO(Polydioxanone), PGA(Polyglycolic acid), PLCL(Poly(lactide-caprolactone)), PCL(Poly(ecaprolactone)), PLLA(Poly-L-lactic acid), PEUU(Poly(ether Urethane Urea)), Cellulose acetate, PEO(Polyethylene oxide), EVOH(Poly(Ethylene Vinyl Alcohol), PVA(Polyvinyl alcohol), PEG(Polyethylene glycol) and PVP(Polyvinylpyrrolidone). Depending on the type of the conductive nano structure, combinations of the natural polymer compound and synthetic polymer compound may be used. In the present disclosure, in the case where the ink composition is implemented to have silver nano wire as the conductive nano structure, it is most easy to adjust the viscosity when using PEG or PEO as the polymer compound.

The scope of the present invention is not limited to the above-described embodiments, but may be implemented in various forms within the scope of the appended claims. Without departing from the gist of the present disclosure as claimed in the claims set, it is deemed to be within the scope of the description of the claims set of the present disclosure to various ranges that can be modified by any one with ordinary knowledge in the technical field to which the present disclosure pertains to.

REFERENCE NUMERALS

110: NOZZLE
120: MAIN ELECTRODE
130: INSULATING LAYER
150: INDUCED AUXILIARY ELECTRODE
180: SUBSTRATE BOTTOM ELECTRODE
S: SUBSTRATE

What is claimed is:

1. An induced electrohydrodynamic jet printing apparatus including an induced auxiliary electrode, comprising:

a nozzle for discharging supplied solution towards an opposite substrate through a nozzle hole formed at one end;

a main electrode coated with an insulator and interpolated inside the nozzle, thus not contacting the solution inside the nozzle but separated from the solution;

the induced auxiliary electrode made of a conductive material and formed at an outer surface of the nozzle; and a voltage supply for applying voltage to the main electrode, wherein the induced auxiliary electrode is formed in a shape extending towards an inner surface of the nozzle through a tip of the nozzle.

2. The induced electrohydrodynamic jet printing apparatus including an induced auxiliary electrode, according to claim 1, wherein the induced auxiliary electrode is not electrically connected, or a voltage different from that of the main electrode is applied, or grounded.

3. The induced electrohydrodynamic jet printing apparatus including an induced auxiliary electrode, according to claim 1, wherein the voltage supply applies a DC voltage to the main electrode.

4. The induced electrohydrodynamic jet printing apparatus including an induced auxiliary electrode, according to claim 1, wherein the voltage supply applies an AC voltage to the main electrode.

5. The induced electrohydrodynamic jet printing apparatus including an induced auxiliary electrode, according to claim 4, wherein the voltage supply supplies the AC voltage of a waveform that includes at least one of sine wave, triangle wave, and square wave.

6. The induced electrohydrodynamic jet printing apparatus including an induced auxiliary electrode, according to claim 1, wherein the main electrode is formed in a needle shape.

7. The induced electrohydrodynamic jet printing apparatus including an induced auxiliary electrode, according to claim 1, wherein the main electrode is formed in a tube shape.

8. The induced electrohydrodynamic jet printing apparatus including an induced auxiliary electrode, according to claim 1, further comprising a substrate bottom electrode disposed below the substrate, and a potential difference is formed between the main electrode and the substrate bottom electrode.

9. The induced electrohydrodynamic jet printing apparatus including an induced auxiliary electrode, according to claim 8, wherein the substrate bottom electrode is grounded.

* * * * *